US006837338B2

(12) United States Patent
Grover

(10) Patent No.: US 6,837,338 B2
(45) Date of Patent: Jan. 4, 2005

(54) LADDER SAFETY DEVICE

(76) Inventor: Steven Barry Grover, 346 State St., East Greenville, PA (US) 18041

( * ) Notice: Subject to any disclaimer, the term of this patent is extended or adjusted under 35 U.S.C. 154(b) by 0 days.

(21) Appl. No.: 10/186,606

(22) Filed: Jul. 2, 2002

(65) Prior Publication Data

US 2004/0003965 A1 Jan. 8, 2004

(51) Int. Cl.[7] ..... E04G 5/02; E04G 3/00; E06C 7/06

(52) U.S. Cl. ..... 182/107; 182/214; 248/229.22

(58) Field of Search ..... 182/107, 214, 182/129, 45, 206; 248/201, 210, 229, 229.25, 229.22, 229.24, 231.7, 231.71

(56) References Cited

U.S. PATENT DOCUMENTS

| | | | | | |
|---|---|---|---|---|---|
| 3,603,431 | A | * | 9/1971 | Nameche et al. | 182/206 |
| 3,910,380 | A | * | 10/1975 | Nameche | 182/206 |
| 4,143,743 | A | * | 3/1979 | Larson | 182/206 |
| 5,383,533 | A | * | 1/1995 | Nikula et al. | 182/107 |
| 6,029,774 | A | * | 2/2000 | Cothern | 182/107 |
| 6,585,080 | B2 | * | 7/2003 | Murray | 182/45 |

* cited by examiner

*Primary Examiner*—Hugh B. Thompson, II
(74) *Attorney, Agent, or Firm*—Lewis M. Brande; Thomas A. McCleary; Brande & McCleary

(57) ABSTRACT

My invention will secure a ladder to a building or roof and will not slide or come loose. Saving Lives.

4 Claims, 4 Drawing Sheets

LADDER SAFETY DEVICE

1. BACKGROUND OF THE INVENTION

Figure 1:
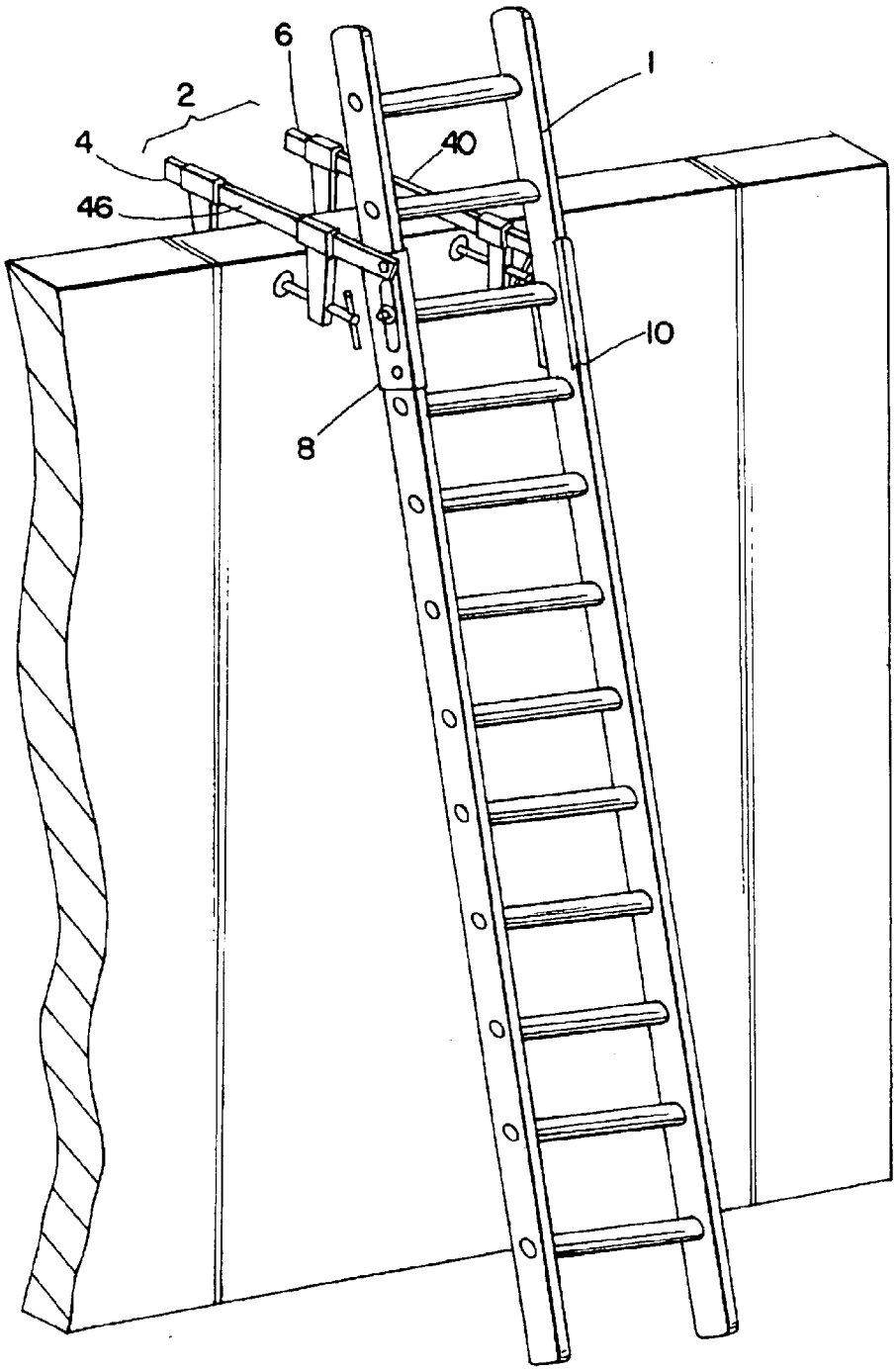
Figure 2:
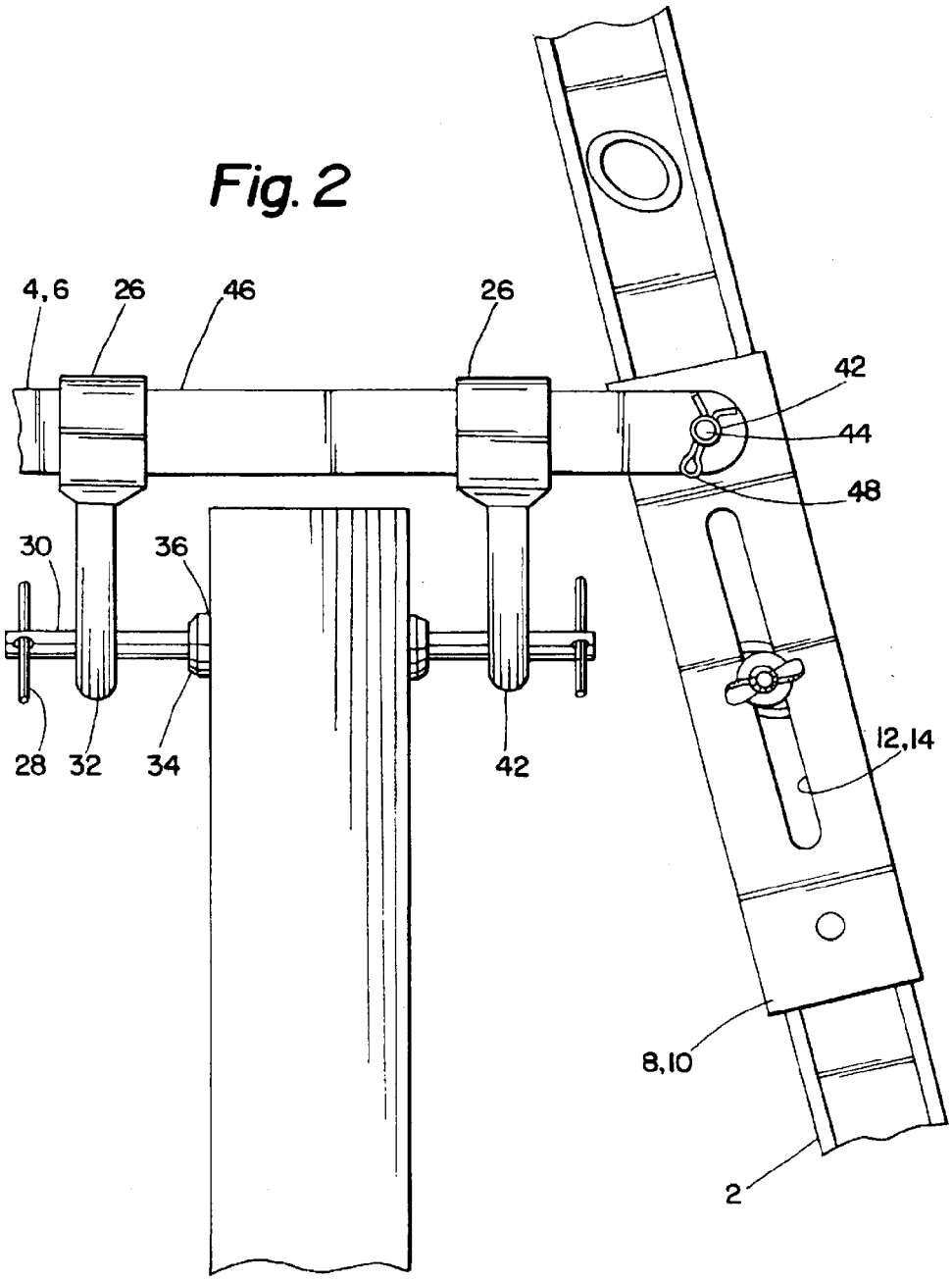
Figure 3:
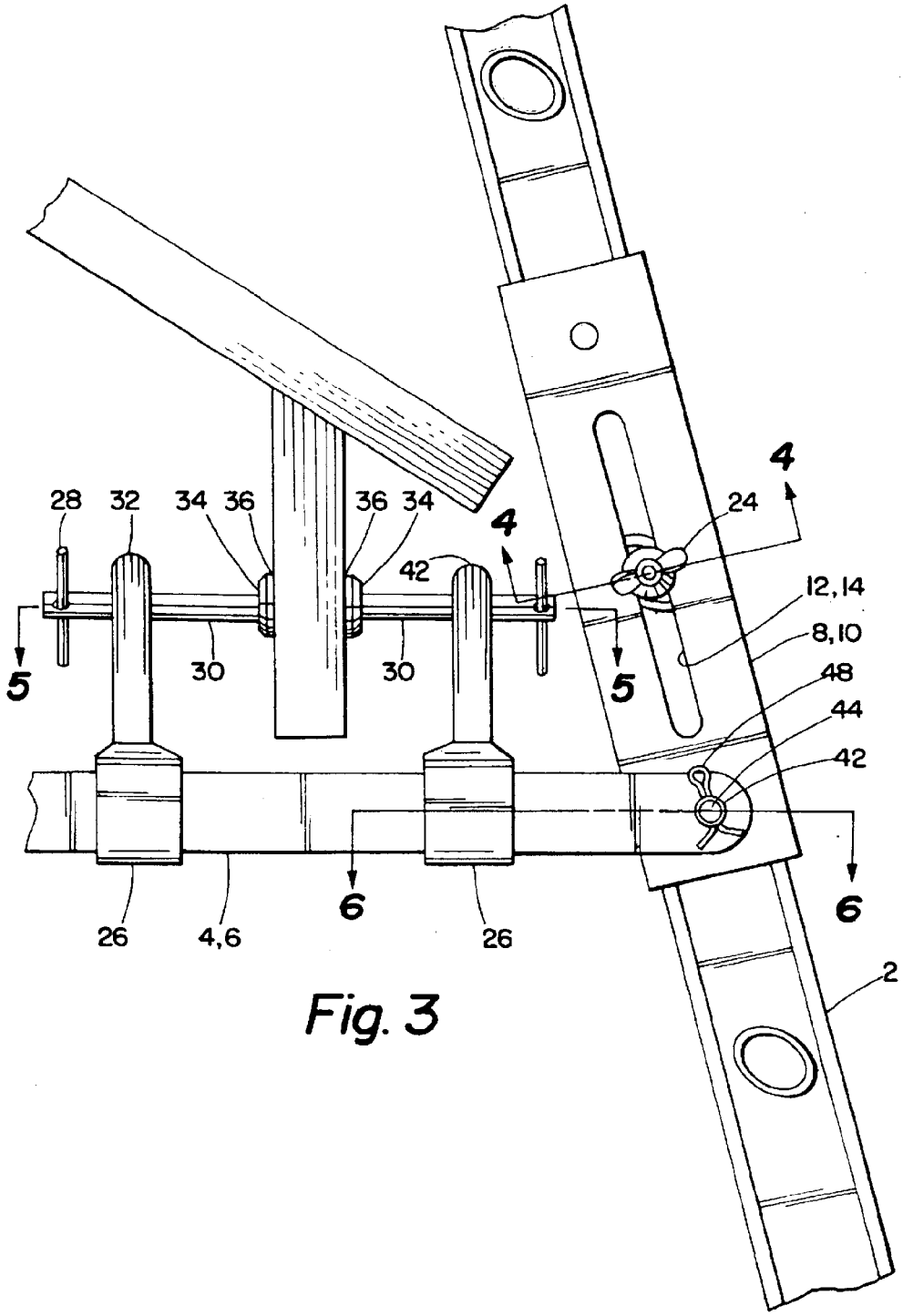
Figure 4:
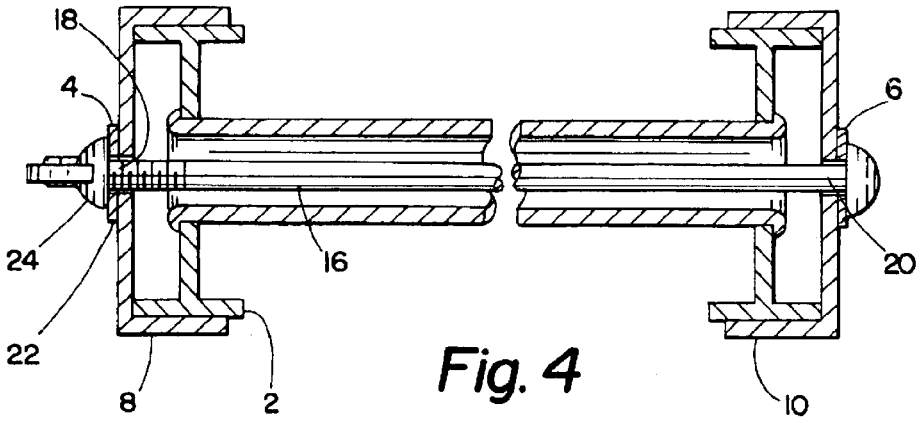
Figure 5:
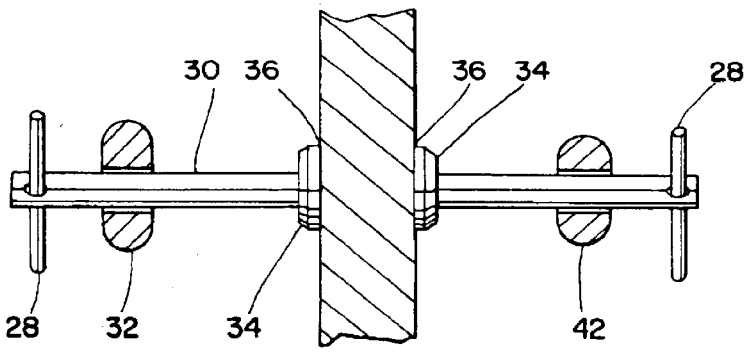
Figure 6:
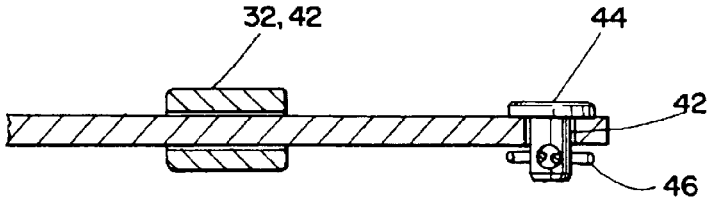

This invention relates to a safety device that will prevent unwanted movement of a ladder when it is positioned against a building structure, storage tank, utility pole or the like. This invention will stabilize the upper portion of the ladder and thereby prevent the ladder from being dislocated. The invention generally consists of a pair of brace plates, where each brace plate is positioned on opposing sides of each ladder rail. A pair of clamps are mounted onto the brace plates. The clamps will be secured onto the building, and the brace plates will be clamped on either side of the ladder using a through rod. The through rod is inserted through the ladder rungs. Generally the ladder rungs are hollow for strength on metallic ladders. This secures the ladder to the structure, preventing the ladder from being dislocated from its desired position, allowing a user to climb the ladder safely.

2. DESCRIPTION OF THE PRIOR ART.

Devices to stabilize ladders are known in the art.

Patent number 5,383,533 by Nikula et al. discloses a "Ladder Clamping Device". This devices secures a ladder to a gutter by using one clamp. The clamp has a flange that uses the top lip of a contoured gutter common in the building industry. This device will use a sliding clamp that has a threaded shaft and allows a face plate to be clamped against a ladder using the gutter as the opposing end of the clamp. The "533" patent differs from the present invention in that the present invention uses two threaded rods together and opposing that clamps onto the building or other structure, while opposing plates clamp onto the ladder. The "533" patent and the present invention differ in that the "533" patent cannot use building structure to clamp down upon, while the present invention can. Additionally the "533" patent can only secure one leg of the ladder, while the present invention can secure both legs of the ladder making a more stable work environment.

Patent number 6,029,774 by Cothern discloses a "Ladder Stabilizing Assembly". This invention uses temporary or permanently attached brackets that will secure a stabilizing assembly. The "774" patent discloses coupling devices that secure the ladder by the use of latches and ladder leg snugging pins. The snugging pins are secured after the ladder has been positioned in the assembly. The gates are operated by a pull mechanism after the workman has gotten off the ladder. The "774" patent differs from the present invention in that it is permanently attached to the building, and the mechanism does not clamp the ladder. The mechanism in the "774" patent locks the ladder into position by the use of a gate. The gate being sprung loaded and preventing the ladder from unwanted motion. A disadvantage of the "774" patent is the use of permanent bolts, where the fascia of a building is damaged, and must be repaired after the removal of the assembly. Another disadvantage of the "774" patent is that the use of bolts in the building's fascia may be dangerous as the wood may be rotted due to water or insect damage. The wood may have enough strength when clamped against, but may not have the required strength when bolted.

3. SUMMARY OF THE INVENTION.

It is therefor the object of the invention the provide a safety device for ladders that will stabilize the ladder against a building or other structure and prevent the ladder from tilting sideways during use.

It is a further object of the invention to provide an assembly that will be temporarily mounted and easily "broken down" or disassembled for re-use.

It is another object of the invention to provide an assembly that will be more securely clamped to buildings or other structures, and provide the most stable device for the user.

These and other objects, features and advantages of the present invention will be come apparent to those skilled the art from the following detailed description and attached drawings, upon which, by way of example, only a preferred and other important embodiments of the invention are described and illustrated.

4. BRIEF DESCRIPTION OF THE DRAWINGS

1. Figure one shows a ladder propped against a wall using the ladder safety device 2. Figure two shows a ladder and the ladder safety device in side view against a wall 3. Figure three shows a ladder and the ladder safety device in side view against the eave of a house.

4. Figure four shows a cross sectional view of the ladder safety device

5. Figure five shows a view of the clamps pressing against a wall/eave.

6. Figure six shows a cross section of the pivot of the ladder safety device

5. DETAILED DESCRIPTION

With respect to FIG. 1, a ladder (1) is shown leaning against a wall. A ladder safety device (2) is shown having a first sliding bar clamp (4), and a second sliding bar clamp (6). The first sliding bar clamp (4) is shown pivotably mounted to a first clamp plate (8). The second sliding bar clamp (6) is shown pivotably mounted to a second clamp plate (10). The first and second sliding bar clamp (4, 6) each have a bar (46). The bar (46) of the first and second sliding bar clamp (4, 6) each has a hole (42) defined therein. A pivot pin (44) is inserted through the hole (42) in the bar (46) thereby pivotably securing the first and second sliding bar clamp (4, 6) to the first and second clamp plates (8, 10) respectively. A standard cotter pin (48) may be used to prevent dislocation of the first and second sliding bar clamp (4, 6) from the first and second clamp plates (8, 10) respectively.

The first clamp plate (8) has a first elongated slot (12) defined therein, and the second clamp plate (10) a second elongated slot (14) defined therein. The first and second elongated slot (12, 14), each allow a tie rod (16) to be inserted therethrough. The tie rod (16) may be circular in shape, or in the preferred embodiment, have an non-circular shape to prevent rotation when the tie rod (16) is inserted through a ladder rung. The non-circular shape of the tie rod (16) prevents rotation of the tie rod (16). The tie rod (16) has a first threaded end (18) and a second threaded end (20) where the first and second threaded end (18, 20) extend through the first and second elongated slot (12, 14) of the first and second clamp plate (8, 10) respectively. An industry standard washer (22) and wing nut (24) are each threadably engaged on the first threaded end (18) and the second threaded end (20) of the tie rod (16). As is common practice in the industry, a washer (22) is positioned between the first clamp plate (8) and the wing nut (24) as well as the second clamp plate (10) and the wing nut (24). When the wing nuts (24) are tightened, the first clamp plate (8) and the second clamp plate (10) are pressed against the ladder rails securing the ladder safety device to the desired position on the ladder. The first clamp plate (8) and the second clamp plate (10) may be slideably adjustable along the ladder rails to allow the ladder safety device (2) to be secured to a sloping wall or eaves.

The first sliding bar clamp (4) has at least one adjustable clamping head (26). The adjustable clamping head has a handle (28). The handle (28) has a threaded portion (30), where the threaded portion (30) extends through the clamp body (32). The threaded portion (30) is threadably engaged within the clamp body (32). The threaded portion (30) of the handle (28) has an end (34), where the end (34) has an adjusting clamping face (36) pivotably mounted thereon. Opposing the adjustable clamping head (26) is a non-adjustable clamping head (not shown), where the non-adjustable clamping head (not shown) has a stationary clamping face (not shown). The stationary clamping face (not shown) is located positionally opposing the adjustable clamping face (36). A second preferred embodiment positions a second adjustable clamping head (40), where the second adjustable clamping head (40) is located opposite to the first adjustable clamping head (26). The use of a second adjustable clamping head (40) on the first and second sliding bar clamp (4, 6) allows for a greater amount of adjustability when securing the ladder to the wall or building.

The adjustable clamping head (26) of the first and second sliding bar clamps (4, 6) are slideably adjusted along the bar (46) of the first and second sliding bar clamps (4, 6). The handle of the adjustable clamping head (26) is rotated to push the adjustable clamping face (36) against the wall or eaves to secure the ladder (2). As the adjustable clamping head (26) is secured against the wall or eaves, the second adjustable clamping head (40), or the non-adjustable clamping head (38) provides opposing force to secure the clamp against the wall or eaves.

What is claimed is:

1. A ladder safety device, comprising:

a. a first sliding bar clamp means, said first sliding bar clamp means being pivotably mounted to a first clamp plate, said first clamp plate having an elongated hole defined therein;

b. a second sliding bar clamp means, said second sliding bar clamp means being pivotably mounted to a second clamp plate, said second clamp plate having an elongated hole defined therein;

c. a tie rod, said tie rod being inserted through a ladder rung, said tie rod having a first threaded end and a second threaded end, said first threaded end of said tie rod extending through said elongated hole in said first clamp plate, said second threaded end of said tie rod extending through said elongated hole in said second clamp plate;

d. a washer, said washer being clamped between a nut means and said first clamp plate, said nut means being threadably engaged on said first threaded end;

e. a second washer, said second washer being clamped between a second nut means and said second clamp plate, said second nut means being threadably engaged on said second threaded end said second nut means being tightened to secure said first and said second sliding bar clamps to said ladder; and f. a wall or eave is positioned between said first and second adjustable clamping heads and said first and second clamping head means, said first and second adjustable clamping heads are adjusted to fixably clamp said first and second sliding bar clamp against said wall or cave, securing said ladder to said wall or eave.

2. The ladder safety device of claim 1, wherein, a. said first sliding bar clamp means has a bar and a first adjustable clamping head, said first adjustable clamping head may be slideably dislocated along said bar of said first sliding bar clamp, said first sliding bar clamp having a first clamping head means, said clamping head means opposing said first adjustable clamping head, said first adjustable clamping head has a handle, said handle being rotatable and allowing an adjustable clamping face to bear against a wall or eaves, holding said first sliding bar clamp in a fixed relationship to the wall or eaves; and b. said second sliding bar clamp means has a second bar and a second adjustable clamping head, said second adjustable clamping head may be slideably dislocated along said bar of said second sliding bar clamp, said second sliding bar clamp having a second clamping head means, said second clamping head means opposing said second adjustable clamping head, said second adjustable clamping head has a handle, said handle being rotatable and allowing an adjustable clamping face to bear against a wall or eaves, holding said second sliding bar clamp in a fixed relationship to the wall or eaves.

3. The ladder safety device of claim 2 wherein, said first and second clamping head means are non-adjustable clamping heads.

4. The ladder safety device of claim 2, wherein, said first and second clamping head means are adjustable clamping heads.

* * * * *